US011404001B2

(12) United States Patent
Zhang et al.

(10) Patent No.: US 11,404,001 B2
(45) Date of Patent: Aug. 2, 2022

(54) PIXEL DRIVING CIRCUIT AND METHOD, DISPLAY PANEL

(71) Applicants: Chengdu BOE Optoelectronics Technology Co., Ltd., Chengdu (CN); BOE TECHNOLOGY GROUP CO., LTD., Beijing (CN)

(72) Inventors: Taoran Zhang, Beijing (CN); Zailong Mo, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 431 days.

(21) Appl. No.: 16/485,131

(22) PCT Filed: Jan. 30, 2019

(86) PCT No.: PCT/CN2019/074024
§ 371 (c)(1),
(2) Date: Aug. 9, 2019

(87) PCT Pub. No.: WO2020/001026
PCT Pub. Date: Jan. 2, 2020

(65) Prior Publication Data

US 2021/0358408 A1 Nov. 18, 2021

(30) Foreign Application Priority Data

Jun. 26, 2018 (CN) ..... 201810673489.7

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01);
(Continued)

(58) Field of Classification Search
None
See application file for complete search history.

(56) References Cited

U.S. PATENT DOCUMENTS

2005/0057189 A1* 3/2005 Kimura ..... G05F 3/242 315/291
2013/0057598 A1* 3/2013 Iwamoto ..... G09G 3/3648 345/690
(Continued)

FOREIGN PATENT DOCUMENTS

CN 102930822 2/2013
CN 103035195 4/2013
(Continued)

OTHER PUBLICATIONS

International Search Report and Written Opinion dated Mar. 29, 2019 for PCT Patent Application PCT/CN2019/074024.
1st Office Action dated Sep. 16, 2019 for Chinese Patent Application 201810673489.7.

*Primary Examiner* — Dorothy Harris
(74) *Attorney, Agent, or Firm* — Xsensus LLP

(57) ABSTRACT

The present disclosure relates to the field of display technologies, and in particular, to a pixel driving circuit, a pixel driving method, and a display panel. The pixel driving circuit includes a first switch circuit, a compensation circuit, a power control circuit, a second switch circuit, a driving circuit, an isolation circuit, and an energy storage circuit.

17 Claims, 6 Drawing Sheets

(52) U.S. Cl.
CPC ..... *G09G 2300/0842* (2013.01); *G09G 2320/0223* (2013.01); *G09G 2320/0233* (2013.01); *G09G 2330/021* (2013.01)

(56) References Cited

U.S. PATENT DOCUMENTS

| | | | | |
|---|---|---|---|---|
| 2014/0168127 | A1* | 6/2014 | Yang ..... | G09G 3/3233 345/173 |
| 2015/0243203 | A1 | 8/2015 | Kim et al. | |
| 2016/0351121 | A1* | 12/2016 | Kim ..... | G09G 3/3233 |
| 2017/0148383 | A1 | 5/2017 | Kim | |
| 2018/0374417 | A1* | 12/2018 | Yang ..... | G09G 3/3233 |

FOREIGN PATENT DOCUMENTS

| | | | | |
|---|---|---|---|---|
| CN | 202917146 | | 5/2013 | |
| CN | 103135846 | | 6/2013 | |
| CN | 104217682 | | 12/2014 | |
| CN | 104464630 | | 3/2015 | |
| CN | 104700782 | | 6/2015 | |
| CN | 106157883 | | 11/2016 | |
| CN | 106486063 | | 3/2017 | |
| CN | 106663407 | | 5/2017 | |
| CN | 107945737 | | 4/2018 | |
| CN | 108806595 | | 11/2018 | |
| KR | 20170060214 | | 6/2017 | |
| WO | WO-2018076719 | A1 * | 5/2018 | ..... G09G 3/3233 |

* cited by examiner

PIXEL DRIVING CIRCUIT AND METHOD, DISPLAY PANEL

CROSS-REFERENCE TO RELATED APPLICATIONS

The present application is based on International Application No. PCT/CN2019/074024, filed on Jan. 30, 2019, which is based upon and claims priority to Chinese Patent Application No. 201810673489.7, filed on Jun. 26, 2018, the entire contents of which are incorporated herein by reference.

TECHNICAL FIELD

The present disclosure relates to the field of display technologies and, more particularly, a pixel driving circuit, a pixel driving method, and a display panel.

BACKGROUND

As a kind of current-type light-emitting device, Organic Light Emitting Diodes (OLED) are increasingly used for high-performance display areas due to their characteristics of self-illumination, fast response, wide viewing angle, and their ability to be fabricated on flexible substrates.

However, during a manufacturing process of a driving transistor, a threshold voltage of the driving transistor at different positions can be different due to the processing variation. Moreover, as the operation time is extended and the use environment is changed, the threshold voltage of the driving transistor can drift, resulting in uneven illumination of the OLED display, which can deteriorate the visual experience of the display screen.

It should be noted that the information disclosed in the Background section above is only for enhancement of understanding of the background of the present disclosure, and thus, can include information that does not constitute prior art known to those of ordinary skill in the art.

SUMMARY

An object of the present disclosure is to provide a pixel driving circuit, a pixel driving method, and a display panel.

According to an aspect of the disclosure, there is provided a pixel driving circuit for driving an electroluminescent element, and the pixel driving circuit including:

a first switch circuit connected to a first node, and configured to be turned on in response to a scan signal to transmit an input signal to the first node;

a compensation circuit connected to a second node, and configured to be turned on in response to the scan signal to transmit a data signal to the second node;

a power control circuit connected to a third node, and configured to be turned on in response to a first control signal to transmit a first power signal to the third node;

a second switch circuit connected to the first node and the second node, and configured to be turned on in response to a second control signal to communicate the first node and the second node;

a driving circuit connected to the second node, the third node, and the fourth node, and configured to be turned on in response to the signal of the second node and output a driving current to the fourth node under the action of a signal of the third node;

an isolation circuit connected to the fourth node and configured to be turned on in response to the second control signal to transmit the driving current to the electroluminescent element; and an energy storage circuit connected between the first node and the third node.

In an exemplary embodiment of the present disclosure, the first switch circuit includes a first transistor, and the first transistor has a first terminal for receiving the input signal, a second terminal connected to the first node, and a control terminal for receiving the scan signal.

In an exemplary embodiment of the present disclosure, the compensation circuit includes a second transistor, and the second transistor has a first terminal for receiving the data signal, a second terminal connected to the second node, and a control terminal for receiving the scan signal.

In an exemplary embodiment of the present disclosure, the power supply control circuit including a third transistor, and the third transistor has a first terminal for receiving the first power signal, a second terminal connected to the third node, and a control terminal for receiving the first control signal.

In an exemplary embodiment of the present disclosure, the second switch circuit includes a fourth transistor, and the fourth transistor has a first terminal connected to the first node, a second terminal connected to the second node, and a control terminal for receiving the second control signal.

In an exemplary embodiment of the present disclosure, the driving circuit includes a driving transistor, and the driving transistor has a first terminal connected to the third node, a second terminal connected to the fourth node, and a control terminal connected to the second node.

In an exemplary embodiment of the present disclosure, the isolation circuit includes a fifth transistor, and the fifth transistor has a first terminal connected to the fourth node, a second terminal connected to the electroluminescent element, and a control terminal for receiving the second control signal.

In an exemplary embodiment of the present disclosure, the energy storage circuit including a storage capacitor, and the storage capacitor has a first terminal connected to the first node, and a second terminal is connected to the third node.

In an exemplary embodiment of the present disclosure, the pixel driving circuit further includes:

a third switch circuit connected to the fourth node and configured to be turned on in response to the scan signal to transmit the input signal to the fourth node.

In an exemplary embodiment of the present disclosure, the third switch circuit includes a sixth transistor, and the sixth transistor has a first terminal for receiving the input signal, a second terminal connected to the fourth node, and a control terminal for receiving the scan signal.

In an exemplary embodiment of the present disclosure, the pixel driving circuit further includes:

a third switch circuit connected to the fourth node and configured to be turned on in response to the scan signal to transmit a second power signal to the fourth node.

In an exemplary embodiment of the present disclosure, the third switch circuit includes a sixth transistor, and the sixth transistor has a first terminal for receiving the second power signal, a second terminal connected to the fourth node, and a control terminal for receiving the scan signal.

In an exemplary embodiment of the present disclosure, the transistors are all N-type thin film transistors or all P-type thin film transistors.

In an exemplary embodiment of the present disclosure, the thin film transistor is one or more of an amorphous silicon thin film transistor, a polysilicon thin film transistor, and an amorphous-indium gallium zinc oxide thin film transistor.

According to an aspect of the disclosure, there is provided a pixel driving circuit for driving an electroluminescent element, and the pixel driving circuit including:

a first transistor connected to a first node, and configured to be turned on in response to a scan signal to transmit an input signal to the first node;

a second transistor connected to a second node, and configured to be turned on in response to a scan signal to transmit a data signal to the second node;

a third transistor connected to a third node, and configured to be turned on in response to a first control signal to transmit a first power signal to the third node;

a fourth transistor connected to the first node and the second node, and configured to be turned on in response to a second control signal to communicate the first node and the second node;

a driving transistor connected to the second node, the third node, and the fourth node, and configured to be turned on in response to a signal of the second node, and output a driving current to the fourth node under the action of a signal of the third node;

a fifth transistor connected to the fourth node, and configured to be turned on in response to the signal of the second control to transmit the driving current to the electroluminescent element; and a storage capacitor connected between the first node and the third node.

According to an aspect of the disclosure, there is provided a pixel driving method for driving the pixel driving circuit according to any of the above, and the pixel driving method including:

in a charging stage, turning on the first switch circuit and the compensation circuit through the scan signal, and turning on the power control circuit through the first control signal, such that the data signal is written into the second node and the energy storage circuit is charged by the input signal and the first power signal;

in a compensation stage, turning on the first switch circuit and the compensation circuit through the scan signal, such that the third node discharges a compensation signal through the driving circuit, the compensation signal being a difference between the data signal and the threshold voltage of the driving circuit;

in a light emitting stage, turning on the second switch circuit and the isolation circuit through the second control signal to write a signal of the first node to the second node, such that the driving circuit is turned on under the action of the signal of the second node, and outputting the driving current to the electroluminescent element through the isolation circuit under the action of the signal of the third node.

In an exemplary embodiment of the present disclosure, the voltage of the input signal is 0.

In an exemplary embodiment of the present disclosure, the pixel driving circuit further includes a third switch circuit connected to the fourth node, and the pixel driving method includes:

in the compensation stage, turning on the third switch circuit through the scan signal, such that the third node discharges to the compensation signal through the driving circuit and the third switch circuit.

In an exemplary embodiment of the present disclosure, the pixel driving circuit further including a third switch circuit connected to the fourth node, and the pixel driving method includes:

in the compensation stage, turning on the third switch circuit through the scan signal to transmit the second power signal to the fourth node.

According to an aspect of the disclosure, there is provided a display panel including the pixel driving circuit according to any one of the above.

It should be noted that the information disclosed in the Background section above is only for enhancement of understanding of the background of the present disclosure, and thus, can include information that does not constitute prior art known to those of ordinary skill in the art.

BRIEF DESCRIPTION OF THE DRAWINGS

The above and other features and advantages of the present disclosure will become more apparent from the detailed description of exemplary embodiments with reference to accompanying drawings. It is apparent that the drawings in the following description are only some of the embodiments of the present disclosure, and other drawings can be obtained from theses drawings by those skilled in the art without additional creative effort. In the drawings.

DETAILED DESCRIPTION

Figure 1:
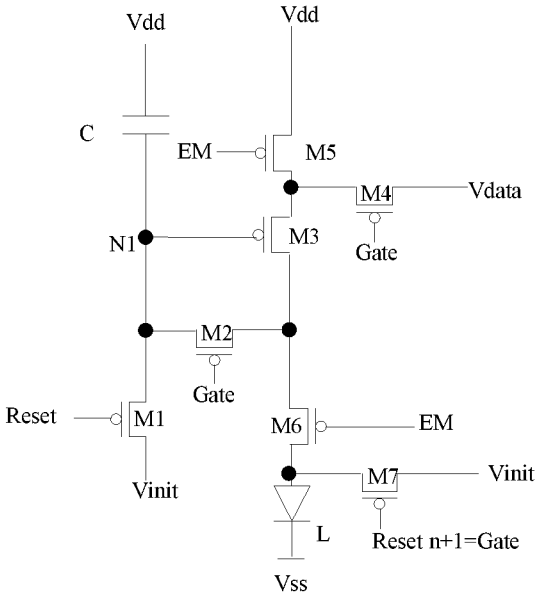
(Prior Art) Fig. 1
FIG. 1 is a schematic diagram of a pixel driving circuit in the related art.

Exemplary embodiments will now be described more fully with reference to the accompanying drawings. However, the exemplary embodiments can be embodied in a variety of forms and should not be construed as being limited to the embodiments set forth herein. Rather, these embodiments are provided to make the present disclosure more complete and thorough, and to fully convey the concept of the exemplary embodiments to those skilled in the art. The described features, structures, or characteristics can be combined in any suitable manner in one or more embodiments. In the following description, numerous specific details are set forth to facilitate thorough understanding of the embodiments of the present disclosure. However, it should be appreciated by one skilled in the art that the technical solution of the present disclosure can be practiced without one or more of the specific details, or other methods, components, materials, devices, steps, etc. can be employed. In other instances, well-known technical solutions are not shown or described in detail to avoid obscuring aspects of the present disclosure.

In addition, the drawings are merely schematic illustrations of the present disclosure, and are not necessarily drawn to scale. The same reference numerals in the drawings denote the same or similar parts, and the repeated description thereof will be omitted.

The inventors have found that different positions of pixels in a display can have different voltage drops (IR Drop) of the power supply, thereby affecting the current driving the OLED. If the threshold voltage and the power supply IR Drop cannot be compensated for, the OLED display can have uneven illumination, which can deteriorate the visual experience of the display screen.

Figure 2:
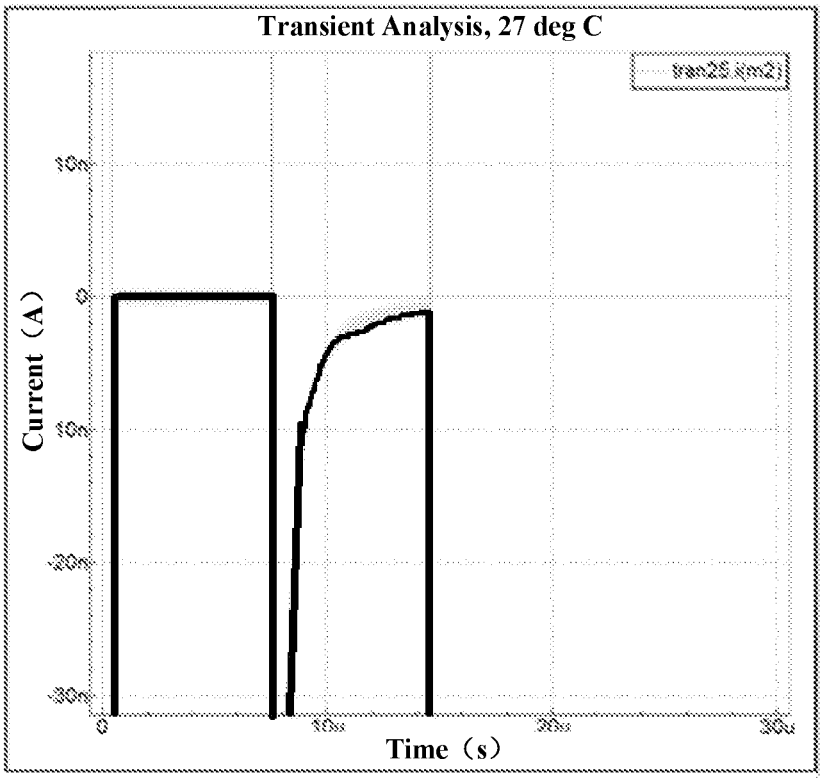
(Prior Art) Fig. 2
FIG. 2 is a current simulation diagram of a pixel driving circuit in the related art.

The pixel circuit compensation in the related art is mostly PMOS voltage compensation technology, in which a compensation circuit (such as 7T1C) with a small number of transistors cannot compensate for the power supply IR Drop, and a compensation circuit (such as 8T1C) with a large number of transistors can be used for compensate for the threshold voltage and the power supply IR Drop, but the pixel structure can be more complicated. As shown in the voltage compensation circuit of FIG. 1, the gate electrodes of the transistor M1 and the transistor M2 are both controlled by the N1 point potential VN, wherein the source electrode S and the drain electrode D of the transistor M2 are not directly connected to the power supply voltage, controlled by the enable writing state of the transistor M3 and the transistor M1, and in a long-term floating state. The transistor M2 has a poor switching characteristics and an unstable writing current, as shown in FIG. 2. Secondly, due to the proper simplification of the circuit, there is no Vdd write compensation. For high PPI and large size panels, there is a problem with the long-range uniformity of the current, which can result in uneven illumination of the OLED display, thereby affecting product quality. Finally, since in the traditional voltage compensation circuit, Vth compensation is written during charging of the capacitor, when the Driver-TFT (M3) is in a critical state, that is, Vg=Vdata+Vth, the charging of the capacitor is completed. Thus, with the transistor M3 has its ability to be turned on weakened, the charging efficiency can be gradually reduced, and can impose a higher requirement on the charging of the capacitor.

Figure 3:
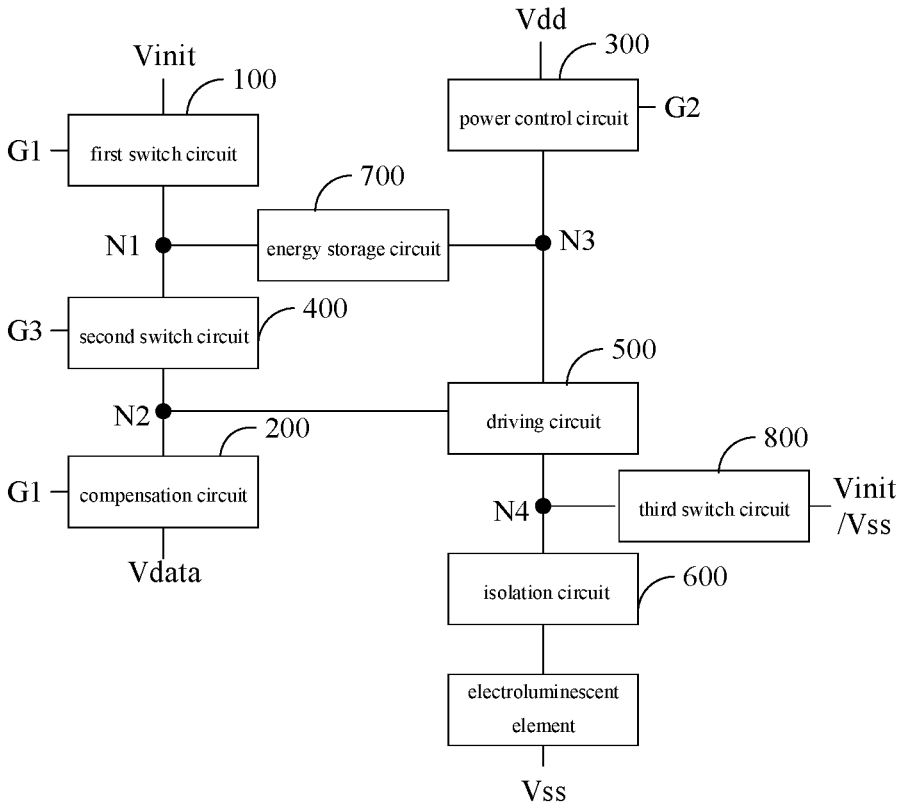
FIG. 3 is a schematic diagram of a pixel driving circuit according to the present disclosure.

A pixel driving circuit for driving an electroluminescent element is according to the exemplary embodiment. Referring to FIG. 3, the pixel driving circuit can include:

a first switch circuit 100 connected to a first node N1, and configured to be turned on in response to a scan signal G1 to transmit an input signal Vinit to the first node N1;

a compensation circuit 200 connected to a second node N2, and configured to be turned on in response to the scan signal G1 to transmit a data signal Vdata to the second node N2;

a power control circuit 300 connected to a third node N3, and configured to be turned on in response to a first control signal G2 to transmit a first power signal Vdd to the third node N3;

a second switch circuit 400 connected to the first node N1 and the second node N2, and configured to be turned on in response to the second control signal G3 to communicate the first node N1 with the second node N2;

a driving circuit 500 connected to the second node N2, the third node N3, and a fourth node N4, and configured to be turned on in response to a signal of the second node N2 and output a driving current to the fourth node N4 under the action of a signal of the third node N3;

an isolation circuit 600 connected to the fourth node N4, and configured to be turned on in response to the second control signal G3 to transmit the driving current to an electroluminescent element L; and an energy storage circuit 700 connected between the first node N1 and the third node N2.

In addition, the pixel driving circuit can further include a third switch circuit 800 connected to the fourth node N4, and configured to be turned on in response to the scan signal G1 to transmit the input signal Vinit to the fourth node N4. By providing the third switch circuit, leakage current of the isolation circuit can be prevented from causing the electroluminescent element to be turned on too early. In addition, in another embodiment, by connecting the third switch circuit to a second power signal Vss, it can reduce or eliminate un-recombined carriers on the interface of the light-emitting layer, eliminate aging factors for the luminescent material, and extend the service life of the luminescent material.

In the pixel driving circuit according to the exemplary embodiment, on one hand, in the compensation stage, the first switch circuit and the compensation circuit are turned on through the scan signal, such that the third node discharges a compensation signal via the driving transistor in the driving circuit to compensate the threshold voltage Vth of the driving transistor. This can eliminate the influence of the threshold voltage of the driving transistor on the driving current, and ensure that the driving current outputted by each pixel driving circuit is uniform, thereby ensuring the uniformity of display luminance of each pixel. On the other hand, in the compensation stage, the pixel driving circuit can eliminate the influence of the first power signal on the voltage between the control terminal and the first terminal of the driving transistor, thereby eliminating the influence of the power IR drop on the display luminance of each pixel to ensure that the driving current outputted by each pixel driving circuit in the light emitting stage is uniform, thereby ensuring the uniformity of display luminance of each pixel.

Figure 4:
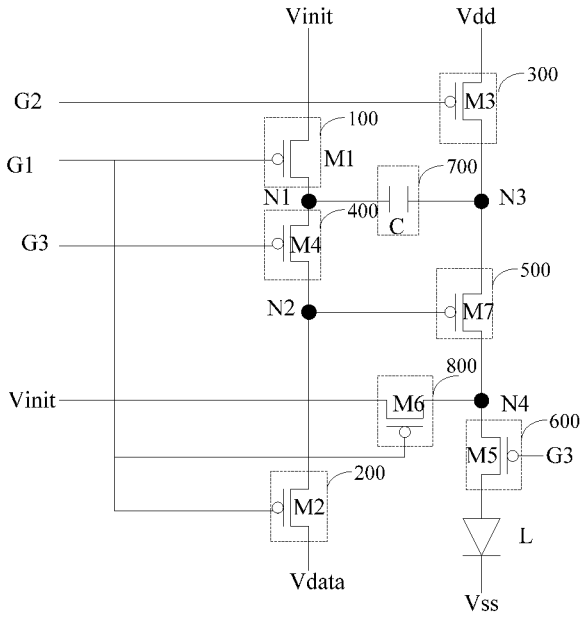
FIG. 4 is a schematic structural diagram of a pixel driving circuit according to the present disclosure.

The respective circuits of the pixel driving circuit in the present exemplary embodiment will be described in detail below with reference to the accompanying drawings. Referring to FIG. 3 and FIG. 4, the first switch circuit includes a first transistor, the compensation circuit includes a second transistor, the power control circuit includes a third transistor, the second switch circuit includes a fourth transistor, the driving circuit includes a driving transistor, the isolation circuit includes a fifth transistor, the energy storage circuit includes a storage capacitor, and the third switch circuit includes a sixth transistor.

As shown in FIG. 4, the first to sixth transistors and the driving transistor each have a control terminal, a first terminal, and a second terminal. Based on this, the connection relationship between the first to sixth transistors (M1 to M6) and the driving transistor M7 in the pixel driving circuit is as follows.

The first switch circuit 100 includes a first transistor M1. The first transistor M1 has a first terminal for receiving the input signal Vinit, a second terminal connected to the first node N1, and a control terminal for receiving the scan signal G1. The compensation circuit 200 includes a second transistor M2. The second transistor M2 has a first terminal for receiving the data signal Vdata, a second terminal connected to the second node N2, and a control terminal for receiving the scan signal G1. The power control circuit 300 includes a third transistor M3. The third transistor M3 has a first terminal for receiving the first power signal Vdd, a second terminal connected to the third node N3, and a control terminal for receiving the first control signal G2. The second switch circuit 400 includes a fourth transistor M4. The fourth transistor M4 has a first terminal connected to the first node N1, a second terminal connected to the second node N2, and a control terminal for receiving the second control Signal G3. The driving circuit 500 includes a driving transistor M7. The driving transistor M7 has a first terminal connected to the third node N3, a second terminal connected to the fourth node N4, and a control terminal is connected to the second node N2. The isolation circuit 600 includes a fifth transistor M5, the first terminal of the fifth transistor M5 being connected to the fourth node N4 and a second terminal being connected to a first electrode of the electroluminescent element L, and a control terminal for receiving the second control signal G3. The energy storage circuit 700 includes a storage capacitor C. The storage capacitor has a first terminal connected to the first node N1 and a second terminal connected to the third node N3. A second electrode of the electroluminescent element L is connected to a second power signal Vss. The third switch circuit 800 includes a sixth transistor M6. The sixth transistor M6 has a first terminal for receiving the input signal Vinit, a second terminal connected to the fourth node N4, and a control terminal for receiving the scan signal G1. In another embodiment, the sixth transistor M6 has a first terminal for receiving the second power signal Vss, a second terminal connected to the fourth node N4, and a control terminal for receiving the scan signal G1.

It should be noted that the control terminal of each transistor can be a gate electrode, the first terminal can be a source electrode, and the second terminal can be a drain electrode. Alternatively, the first terminal and the second terminal of the transistor can be interchanged. In the present exemplary embodiment, all of the transistors can be N-type thin film transistors or P-type thin film transistors. It should be noted that for different transistor types, the level signals of the respective signal terminals can be adjusted accordingly. The thin film transistor can be one or more of an amorphous silicon thin film transistor, a polysilicon thin film transistor, and an amorphous-indium gallium zinc oxide thin film transistor.

For example, when the first to sixth transistors are P-type thin film transistors, the first terminal of the transistor can be a source electrode, and the second terminal of the transistor can be a drain electrode. In another example, when the first to sixth transistors are N-type thin film transistors, the first terminal of the transistor can be a drain electrode, and the second terminal of the transistor can be a source electrode. It should be noted that the above transistors can also be other types of transistors, which are not specifically limited in the exemplary embodiment.

In addition, each transistor can be an enhancement transistor or a depletion transistor, which is not specifically limited in the exemplary embodiment. It should be noted that since the source electrode and the drain electrode of the transistor are symmetrical, the source electrode and the drain electrode of the transistor can be interchanged.

The driving transistor M7 has a control terminal, a first terminal, and a second terminal. For example, the control terminal of the driving transistor M7 can be a gate electrode, the first terminal can be a source electrode, and the second terminal can be a drain electrode. In another example, the control terminal of the driving transistor M7 can be a gate electrode, the first terminal can be a drain electrode, and the second terminal can be a source electrode. In addition, the driving transistor M7 can be an enhancement driving transistor or a depletion driving transistor, which is not particularly limited in the exemplary embodiment.

The type of the storage capacitor C can be selected according to a specific circuit. For example, it can be a MOS capacitor, a metal capacitor, or a double poly capacitor, and the like, which is not particularly limited in the exemplary embodiment.

The electroluminescent element L is a current-driven electroluminescent element that is controlled to emit light by a current flowing through the driving transistor M7. For example, the electroluminescent element can be an OLED, but electroluminescent element L in the exemplary embodiment is not limited to this. Further, the electroluminescent element L has a first electrode and a second electrode. For example, the first electrode of the electroluminescent element L can be an anode and the second electrode can be a cathode. In addition to this, the first electrode and second electrode of the electroluminescent element L are also interchangeable.

Figure 5:
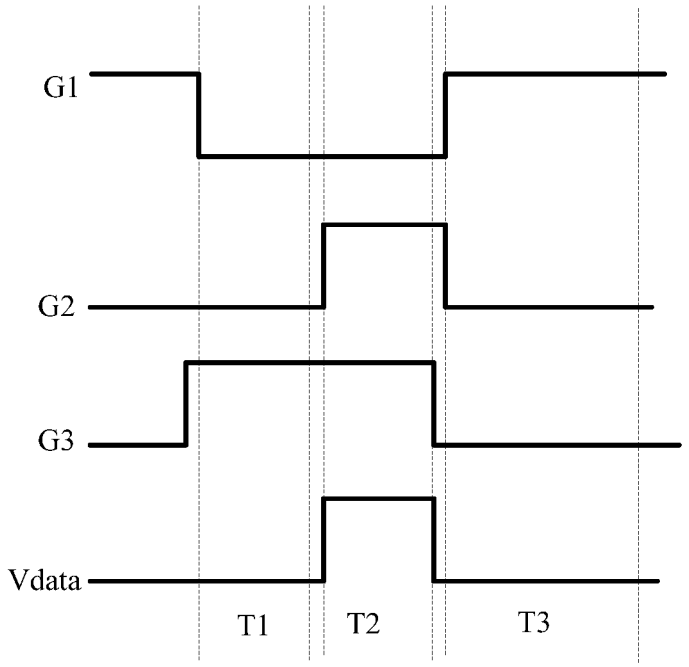
FIG. 5 is a timing chart showing an operation of a pixel driving circuit according to an exemplary embodiment of the present disclosure.

In an exemplary embodiment of the present disclosure, there is also provided a pixel driving method for driving the pixel driving circuit as shown in FIGS. 3 and 4. Hereinafter, the operation process of the pixel driving circuit in FIG. 3 and FIG. 4 will be described in detail with reference to the timing chart of the pixel driving circuit as shown in FIG. 5, taking the transistors being P-type thin film transistors and the driving transistor being a P-type driving transistor as an example. Since the transistors are all P-type thin film transistors, the first terminal of each transistor is a source electrode, the second terminal of each transistor is a drain electrode, and the turning-on signal of each transistor is a low level signal, and the turn-off signal of each transistor is a high level signal. The driving timing diagram depicts the scan signal G1, the first control signal G2, the second control signal G3, and the data signal Vdata. In addition to this, the first power supply signal Vdd maintains a high level signal, the second power supply signal Vss maintains a low level signal, and the input signal Vinit maintains a low level signal.

Based on this, the operation process of the pixel driving circuit can specifically include the following stages.

Figure 6:
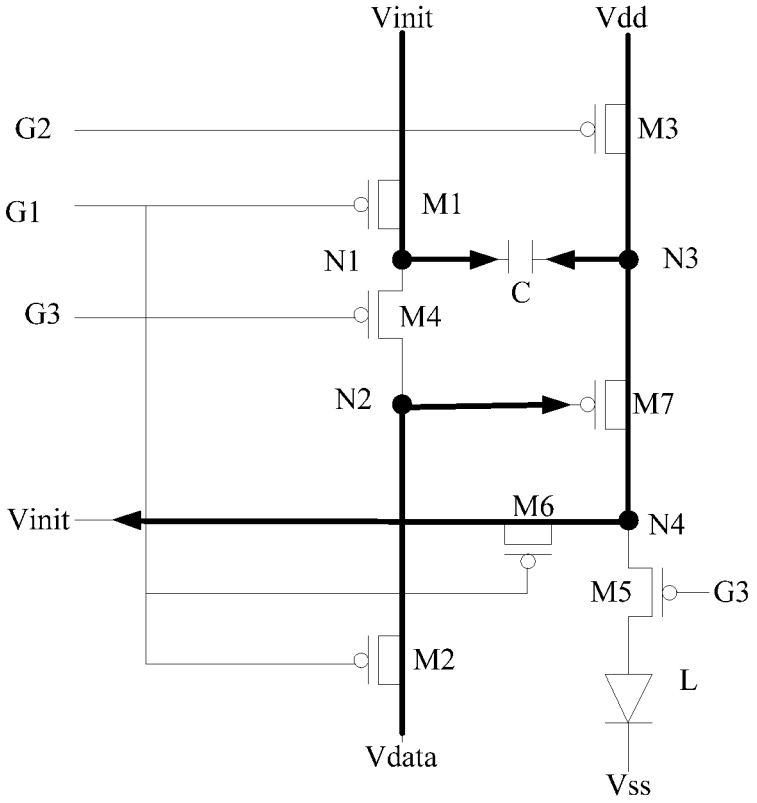
FIG. 6 is an equivalent circuit diagram of a pixel driving circuit in a charging stage according to the present disclosure.

In a T1 stage, that is, the charging stage, the first switch circuit and the compensation circuit can be turned on through a scan signal, and the power control circuit is turned on through the first control signal to write the data signal to the second node and to charge the energy storage circuit with the input signal and the first power signal. Specifically, as shown in FIG. 6, since the scan signal G1 and the first control signal G2 in the T1 stage are low level signals, the second control signal G3 is a high level signal, and the data signal Vdata is a low level signal, the first transistor M1, the second transistor M2, and the sixth transistor M6 are turned on through the low level signal of the scan signal G1, the third transistor M3 is turned on through the low level signal of the first control signal G2, and the four transistors M4 and the fifth transistor M5 are in an turned-off state. In this way, the input signal Vinit can be transmitted to the first node N1 through the first transistor M1, the data signal Vdata is written into the second node N2 through the second transistor M2, and the first power signal Vdd is written into the third node N3 through the third transistor M3 at the same time, to realize the function of charging the storage capacitor C in the energy storage circuit by the input signal Vinit and the first power signal Vdd. Since the data signal Vdata is at a low level, the driving transistor M7 can be turned on, and the voltage signal of the third node N3 is written into the fourth node N4 through the driving transistor M7, and the input signal Vinit is written into the fourth node N4 at the same time. At this time, the voltage signal of the first node is the input signal Vinit, the voltage signal of the second node is the data signal Vdata, the voltage of the third node is Vdd, and the voltage signal of the fourth node is Vdd−Vinit.

The data signal Vdata can change the gate voltage of the driving transistor M7 through the second transistor M2. According to the driving current $$I = \frac{W}{2L}\mu C_{ox}(V_{GS} - V_{TH})^2,$$

where W/L is the aspect ratio of the driving transistor M7, μ is the hole mobility, $C_{ox}$ is the gate capacitance, $V_{GS}$ is the gate-source voltage of the driving transistor M7, and VTH is the threshold voltage of the driving transistor M7, since the $V_{GS}$ of the driving transistor M7 is Vdata−Vdd, the driving current of the driving transistor M7 is calculated as $$I = \frac{W}{2L}\mu C_{ox}(V_{data} - V_{dd} - V_{th})^2.$$

Figure 9:
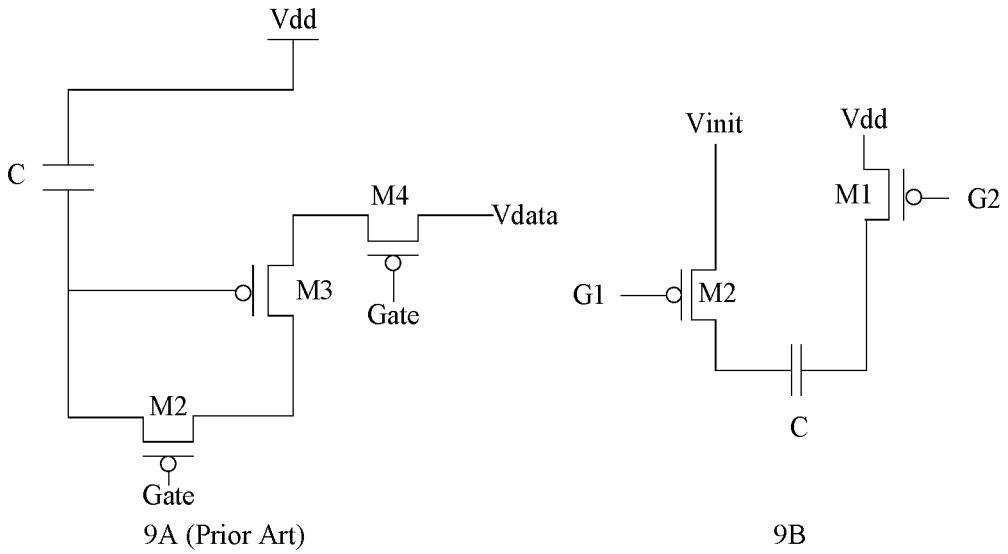
FIG. 9A is a schematic diagram of capacitance charging of the pixel driving circuit of FIG. 1.
FIG. 9B is a schematic diagram of capacitance charging of a pixel driving circuit according to the present disclosure.

In this stage, the charging process is as shown in FIG. 9B, and the first electrode plate of the storage capacitor C can be directly power charged by the input signal Vinit, and the second electrode plate of the storage capacitor C can be directly power charged by the first power signal Vdd. It can achieve the effect of directly charging the capacitor through the power signal, improving the charging speed and charging efficiency of the capacitor, and shortening the charging time.

Figure 7:
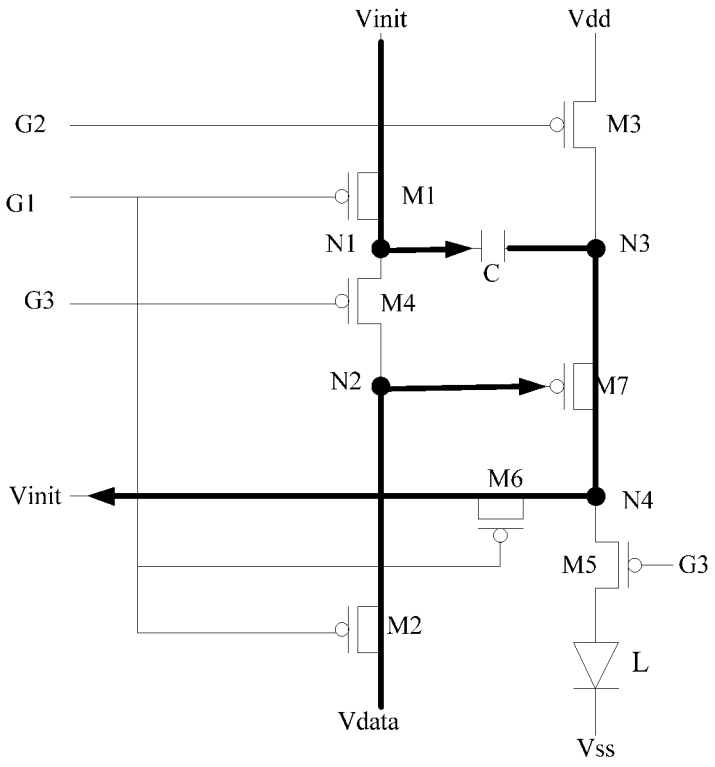
FIG. 7 is an equivalent circuit diagram of a pixel driving circuit in a compensation stage according to the present disclosure.

In a T2 stage, that is, the compensation stage, the first switch circuit and the compensation circuit can be turned on through the scan signal G1 to cause the third node N3 to discharge the compensation signal through the driving circuit. Specifically, as shown in FIG. 7, since in the T2 stage, the scan signal G1 is a low level signal, the first control signal G2 and the second control signal G3 are high level signals, and the data signal Vdata is a high level signal, the first transistor M1, the second transistor M2 and the sixth transistor M6 are turned on under the action of low level signals, and the third transistor M3, the fourth transistor M4, and the fifth transistor M5 are turned off. In this way, the input signal Vinit can be written into the first node N1 through the first transistor M1, the data signal Vdata is written into the second node N2 through the second transistor M2, and the input signal Vinit is written into the fourth node N4 through the second transistor M6 at the same time.

The third switch circuit is turned on through the scan signal to discharge the third node N3 to the compensation signal through the driving circuit and the third switch circuit. Specifically, since for the driving transistor M7, VGS <Vth after charging, the second electrode plate of the storage capacitor C can be discharged to cause current to flow to the sixth transistor M6. When the voltage of the second electrode plate of the capacitor is the compensation voltage, that is, the difference (Vdata−Vth) between the data signal and the threshold voltage of the driving circuit, for the driving transistor M7, VGS=Vth, the driving transistor M7 is in the turned-off state, and Vth is written into the second electrode plate of the storage capacitor, to complete the compensation. In this stage, by turning on the sixth transistor M6, leakage current flowing into the electroluminescent element L or the OLED can be reduced, such that one frame of black image can be added, and the short-time afterimage can be alleviated. In addition to this, the sixth transistor M6 is turned on, and it is possible to prevent the leakage current of the fifth transistor M5 from causing the electroluminescent element L device to be turned on too early.

Figure 10:
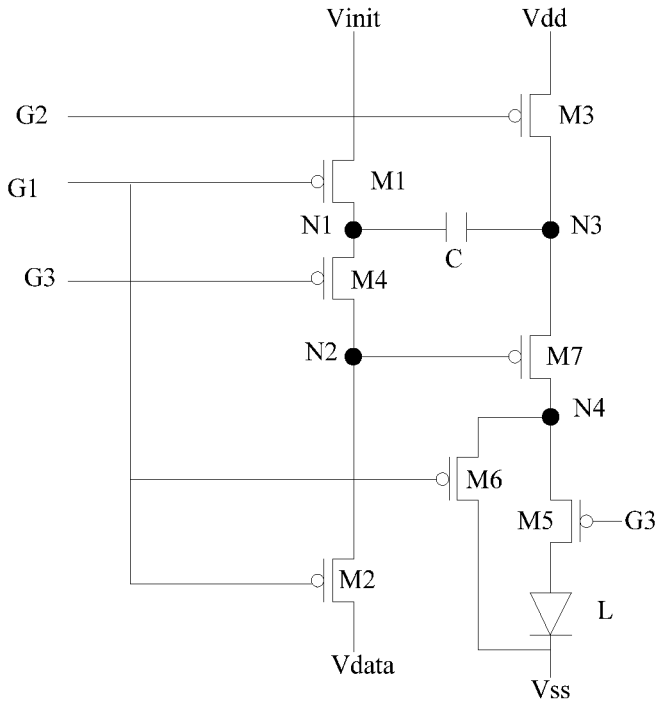
FIG. 10 is another schematic structural diagram of a pixel driving circuit according to the present disclosure.
Figure 11:
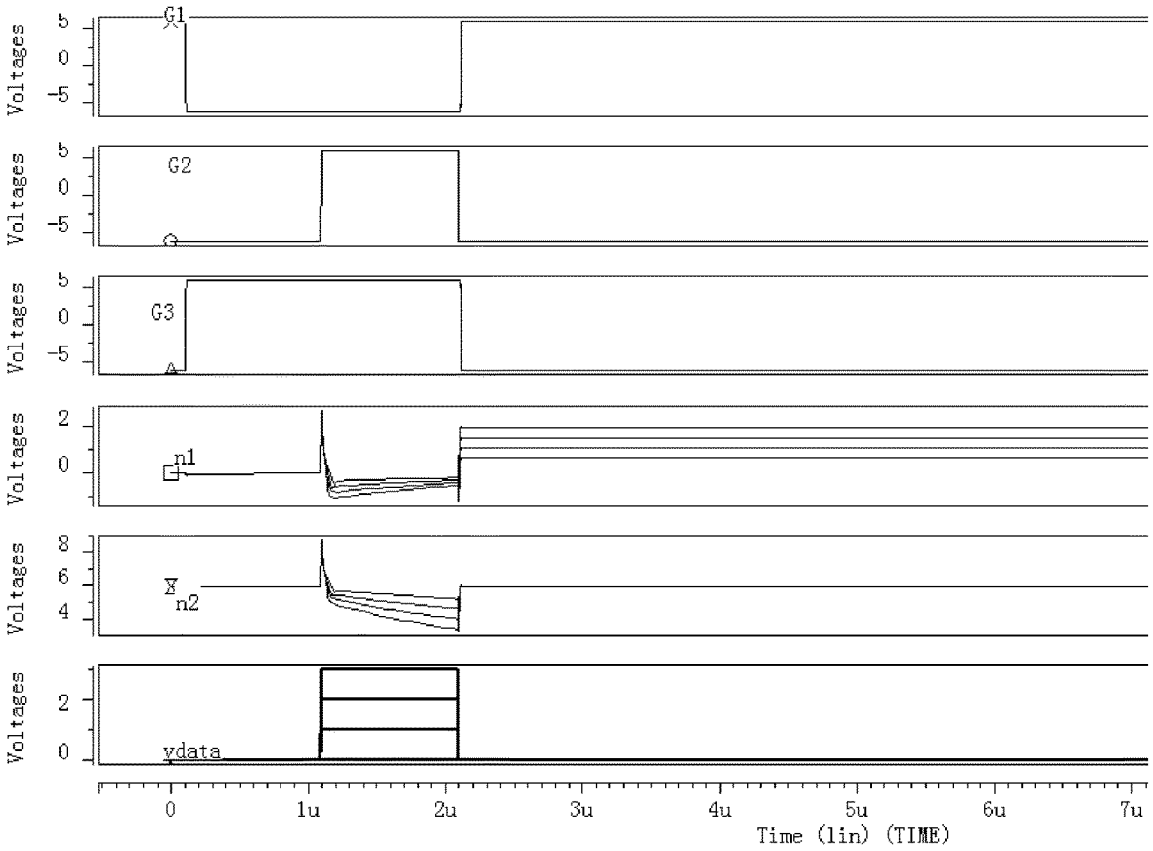
FIG. 11 is a voltage simulation diagram of each node in a pixel driving circuit according to the present disclosure.
Figure 12:
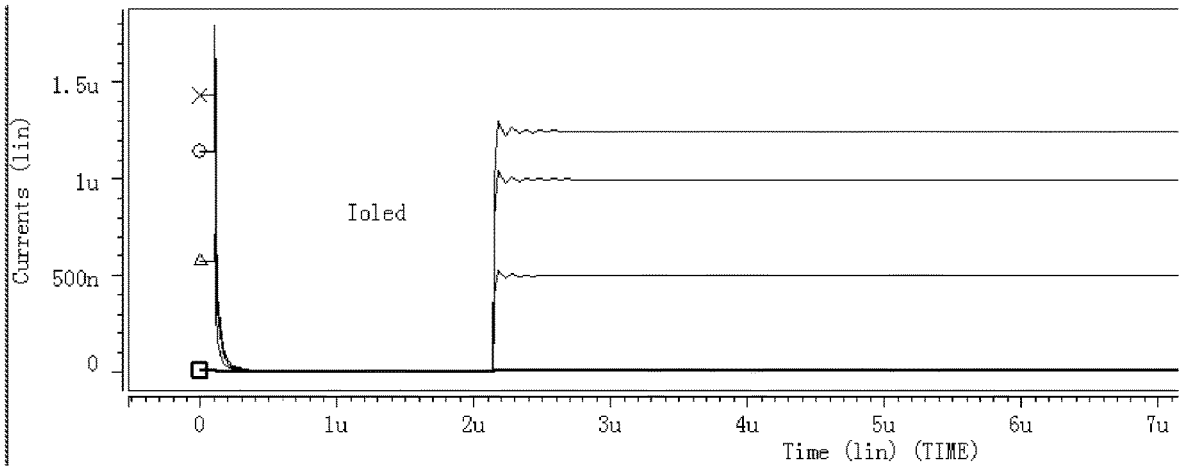
FIG. 12 is a simulation diagram of driving currents of a pixel driving circuit according to the present disclosure.

In another embodiment of the present disclosure, the third switch circuit can include a sixth transistor M6. As shown in FIG. 10, the sixth transistor has a first terminal for receiving the second power signal Vss, and a second terminal connected to the fourth node N4, and a control terminal for receiving the scan signal G1. In the compensation stage, the sixth transistor M6 can be turned on in response to the low level signal of the scan signal G1 to transmit the second power signal Vss to the fourth node N4. In this way, the first terminal and the second terminal of the electroluminescent element L are connected. For the electroluminescent element L, when the carriers of the light-emitting layer are recombined, the cathode and the anode of the electroluminescent element L can be short-circuited by such a connection to eliminate the un-recombined carriers on the interface of the light-emitting layer, eliminate aging factors for the luminescent material, and extend the service life of the luminescent material.

Figure 8:
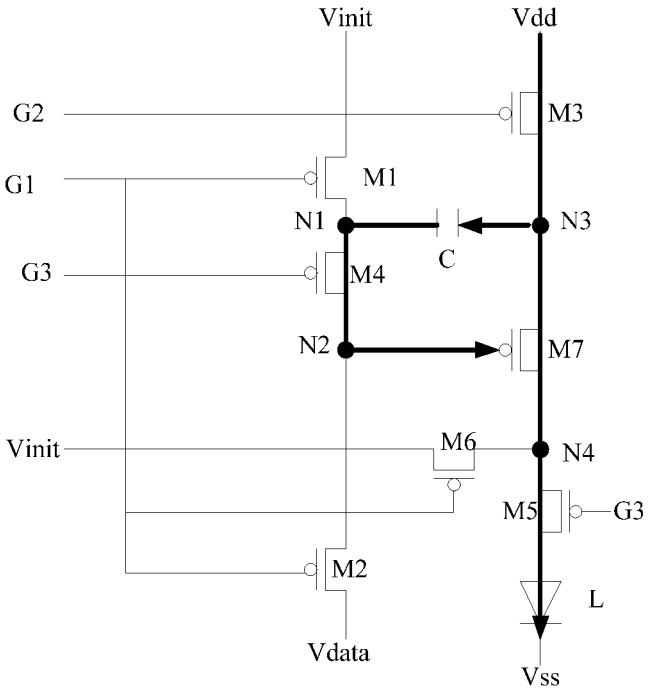
FIG. 8 is an equivalent circuit diagram of a pixel driving circuit in a light emitting stage according to the present disclosure.

In a T3 stage, that is, the light-emitting stage, the second switch circuit and the isolation circuit can be turned on through the second control signal to write the signal of the first node to the second node, such that the driving circuit is turned on under the action of the signal of the second node, and output a driving current to the electroluminescent element through the isolation circuit under the action of the signal of the third node. Specifically, as shown in FIG. 8, the scan signal G1 is a high level signal, and the first control signal G2, the second control signal G3, and the data signal are all low level signals. Under the action of the high level signal of the scan signal G1, the first transistor M1, the second transistor M2, and the sixth transistor M6 are turned off, and under the action of the low level signal of the first control signal G2, the third transistor M3 is turned on. The fourth transistor M4 and the fifth transistor M5 are turned on under the action of the low level signal of the second control signal G3. As a result, the gate voltage of the driving transistor M7 is Vinit, the third transistor M3 is turned on, and the capacitor C jump-changes, such that the gate voltage of the driving transistor M7 is adjusted to Vinit+Vdd−Vdata+Vth, and the VGS of the driving transistor M7 is Vinit−Vdata, to cancel out the first power supply signal Vdd and the threshold voltage Vth, to achieve the purpose of compensating for IR Drop and Vth. The driving current $$I = \frac{W}{2L}\mu C_{ox}(V_{init} - V_{data})^2$$

outputted by the driving transistor M7 is independent of Vdd and Vth. Assuming that Vinit=0V, then $$I = \frac{W}{2L}\mu C_{ox}V_{data}^2,$$

is only related to Vdata, and the purpose of compensating for Vdd and Vth is achieved. By setting the input signal Vinit to 0 in the present exemplary embodiment, the influence of the input signal on the driving current can be eliminated.

It can be seen that the driving current output from the driving transistor is independent of the threshold voltage Vth of the driving transistor M7 and the first power supply signal Vdd. Therefore, in the compensation stage, the first switch circuit 100 and the compensation circuit 200 are turned on through the scan signal G1, such that the third node N3 discharges the compensation signal through the driving transistor M7 in the driving circuit 500, by writing Vdata and Vth into the third node, the threshold voltage Vth of the driving transistor M7 can be compensated. This can eliminate the influence of the threshold voltage Vth of the driving transistor M7 on the driving current, and ensure that the driving current outputted by each pixel driving circuit is uniform, thereby ensuring the uniformity of display luminance of each pixel. Meanwhile, it can eliminate the influence of the first power signal Vdd on the voltage between the control terminal and the first terminal of the driving transistor M7, thereby eliminating the influence of the power IR drop on the display luminance of each pixel to ensure that the driving current outputted by each pixel driving circuit in the light emitting stage is uniform, thereby ensuring the uniformity of display luminance of each pixel.

The full P-type thin film transistors scheme has the following advantages: for example, strong noise suppression; for example, low level conduction, which can be easily implement in charge management; for example, being simple for manufacturing and having relatively low cost; and for example; having better stability and the like.

It should be noted that, in the foregoing specific embodiments, all the transistors are P-type thin film transistors; however, those skilled in the art can easily obtain pixel driving circuits in which all transistors are N-type thin film transistors from the pixel driving circuit according to the present disclosure. In an exemplary embodiment of the present disclosure, all of the transistors can be N-type thin film transistors. Since the transistors are all N-type thin film transistors, the turned-on signals of the transistors are high level signals, the first terminals of the transistors are all drain electrodes, and the second terminals of the transistors are all source electrodes. Of course, the pixel driving circuit according to the present disclosure can be changed to a CMOS (Complementary Metal Oxide Semiconductor) circuit or the like, and is not limited to the pixel driving circuit according to the embodiment, and details are not described herein again.

An exemplary embodiment also provides a display panel including the above-described pixel driving circuit. The display panel includes a plurality of scan lines for providing scan signals; a plurality of data lines for providing data signals; and a plurality of pixel driving circuits electrically connected to the scan lines and the data lines; and at least one of the pixel driving circuits includes any of the above-described pixel driving circuits in the present exemplary embodiment. The display panel can include any product or component having a display function, such as a mobile phone, a tablet computer, a television, a notebook computer, a digital photo frame, a navigator, and the like.

In the present exemplary embodiment, by providing the pixel driving circuit shown in FIG. 4 in the display panel, it can compensate the threshold voltage Vth of the driving transistor M7 and eliminate the influence of the threshold voltage Vth of the driving transistor M7 on the driving current, and ensure that the driving current outputted by each pixel driving circuit is uniform, thereby ensuring the uniformity of display luminance of each pixel. Meanwhile, it can eliminate the influence of the first power signal Vdd on the voltage between the control terminal and the first terminal of the driving transistor M7, thereby eliminating the influence of the power IR drop on the display luminance of each pixel, to ensure that the driving current outputted by each pixel driving circuit in the light emitting stage is uniform, thereby ensuring the uniformity of display luminance of each pixel.

It should be noted that the specific details of each module circuit in the display panel have been described in detail in the corresponding pixel driving circuit, and therefore will not be described herein.

It should be noted that although several modules or circuits for devices for performing actions are mentioned in the detailed description above, such division is not mandatory. In fact, in accordance with embodiments of the present disclosure, the features and functions of the two or more modules or circuits described above can be embodied in one module or circuit. Alternatively, vice versa, the features and functions of one of the modules or circuits described above can be further divided into multiple modules or circuits.

In addition, although the various steps of the method of the present disclosure are described in a particular order in the drawings, this is not required or implied that the steps must be performed in the specific order, or all the steps shown must be performed to achieve the desired result. Additionally or alternatively, certain steps can be omitted, multiple steps being combined into one step, and/or one step can be decomposed into multiple steps and the like.

Other embodiments of the disclosure will be apparent to those skilled in the art from consideration of the specification and practice of the disclosure disclosed herein. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

What is claimed is:

1. A system, comprising:

a pixel driving circuit for driving an electroluminescent element, comprising:

a first switch circuit connected to a first node, and configured to be turned on in response to a scan signal to transmit an input signal to the first node;

a compensation circuit connected to a second node, and configured to be turned on in response to the scan signal to transmit a data signal to the second node;

a power control circuit connected to a third node, and configured to be turned on in response to a first control signal to transmit a first power signal to the third node;

a second switch circuit connected to the first node and the second node, and configured to be turned on in response to a second control signal to communicate the first node and the second node;

a driving circuit connected to the second node, the third node, and a fourth node, and configured to be turned on in response to a signal of the second node and output a driving current to the fourth node under action of a signal of the third node;

an isolation circuit connected to the fourth node, and configured to be turned on in response to the second control signal to transmit the driving current to the electroluminescent element;

a third switch circuit connected to the fourth node and configured to be turned on in response to the scan signal to transmit the input signal or a second power signal to the fourth node; and an energy storage circuit connected between the first node and the third node, and configured to be charged by the input signal and the first power signal in response to the scan signal and the first control signal, wherein, in a period of charging the energy storage circuit by the input signal and the first power signal, the signal of the second node is the data signal that turns on the driving circuit such that a voltage signal of the third node is written into the fourth node through the driving circuit.

2. The system according to claim 1, wherein:

the first switch circuit comprises a first transistor; and the first transistor has a first terminal for receiving the input signal, a second terminal connected to the first node, and a control terminal for receiving the scan signal.

3. The system according to claim 2, wherein the transistors are all N-type thin film transistors or all P-type thin film transistors.

4. The system according to claim 3, wherein the thin film transistor is at least one of: an amorphous silicon thin film transistor, a polysilicon thin film transistor, and an amorphous-indium gallium zinc oxide thin film transistor.

5. The system according to claim 1, wherein:

the compensation circuit comprises a second transistor; and the second transistor has a first terminal for receiving the data signal, a second terminal connected to the second node, and a control terminal for receiving the scan signal.

6. The system according to claim 1, wherein:

the power supply control circuit comprises a third transistor; and the third transistor has a first terminal for receiving the first power signal, a second terminal connected to the third node, and a control terminal for receiving the first control signal.

7. The system according to claim 1, wherein:

the second switch circuit comprises a fourth transistor; and the fourth transistor has a first terminal connected to the first node, a second terminal connected to the second node, and a control terminal for receiving the second control signal.

8. The system according to claim 1, wherein:

the driving circuit comprises a driving transistor; and the driving transistor has a first terminal connected to the third node, a second terminal connected to the fourth node, and a control terminal connected to the second node.

9. The system according to claim 1, wherein:

the isolation circuit comprises a fifth transistor; and the fifth transistor has a first terminal connected to the fourth node, a second terminal connected to the electroluminescent element, and a control terminal for receiving the second control signal.

10. The system according to claim 1, wherein:

the energy storage circuit comprising a storage capacitor; and the storage capacitor has a first terminal connected to the first node, and a second terminal is connected to the third node.

11. The system according to claim 1, wherein:

the third switch circuit comprises a sixth transistor; and the sixth transistor has a first terminal for receiving the input signal or the second power signal, a second terminal connected to the fourth node, and a control terminal for receiving the scan signal.

12. The system according to claim 1, further comprising: a display panel, the display panel comprising the pixel driving circuit.

13. A pixel driving circuit for driving an electroluminescent element, comprising:

a first transistor connected to a first node, and configured to be turned on in response to a scan signal to transmit an input signal to the first node;

a second transistor connected to a second node, and configured to be turned on in response to a scan signal to transmit a data signal to the second node;

a third transistor connected to a third node, and configured to be turned on in response to a first control signal to transmit a first power signal to the third node;

a fourth transistor connected to the first node and the second node, and configured to be turned on in response to a second control signal to communicate the first node and the second node;

a driving transistor connected to the second node, the third node, and a fourth node, and configured to be turned on in response to a signal of the second node and output a driving current to the fourth node under action of a signal of the third node;

a fifth transistor connected to the fourth node, and configured to be turned on in response to the signal of the second control to transmit the driving current to the electroluminescent element;

a sixth transistor connected to the fourth node and configured to be turned on in response to the scan signal to transmit the input signal or a second power signal to the fourth node; and a storage capacitor connected between the first node and the third node, and configured to be charged by the input signal and the first power signal in response to the scan signal and the first control signal, wherein, in a period of charging the energy storage circuit by the input signal and the first power signal, the signal of the second node is the data signal that turns on the driving transistor such that a voltage signal of the third node is written into the fourth node through the driving transistor.

14. A pixel driving method for driving a pixel driving circuit comprising:

providing the pixel driving circuit, the pixel driving circuit comprising:

a first switch circuit connected to a first node, and configured to be turned on in response to a scan signal to transmit an input signal to the first node;

a compensation circuit connected to a second node, and configured to be turned on in response to the scan signal to transmit a data signal to the second node;

a power control circuit connected to a third node, and configured to be turned on in response to a first control signal to transmit a first power signal to the third node;

a second switch circuit connected to the first node and the second node, and configured to be turned on in response to a second control signal to communicate the first node and the second node;

a driving circuit connected to the second node, the third node, and a fourth node, and configured to be turned on in response to a signal of the second node and output a driving current to the fourth node under action of a signal of the third node;

an isolation circuit connected to the fourth node, and configured to be turned on in response to the second control signal to transmit the driving current to the electroluminescent element;

a third switch circuit connected to the fourth node and configured to be turned on in response to the scan signal to transmit the input signal or a second power signal to the fourth node; and an energy storage circuit connected between the first node and the third node;

in a charging stage, turning on the first switch circuit and the compensation circuit through the scan signal, and turning on the power control circuit through the first control signal, such that the data signal is written into the second node and the energy storage circuit is charged by the input signal and the first power signal, and the signal of the second node is the data signal that turns on the driving circuit such that a voltage signal of the third node is written into the fourth node through the driving circuit;

in a compensation stage, turning on the first switch circuit and the compensation circuit through the scan signal, such that the third node discharges a compensation signal through the driving circuit, the compensation signal being a difference between the data signal and the threshold voltage of the driving circuit;

in a light emitting stage, turning on the second switch circuit and the isolation circuit through the second control signal to write a signal of the first node to the second node, such that the driving circuit is turned on under the action of the signal of the second node; and outputting the driving current to the electroluminescent element through the isolation circuit under the action of the signal of the third node.

15. The pixel driving method according to claim 14, wherein the voltage of the input signal is 0V.

16. The pixel driving method according to claim 14, wherein:

the pixel driving method further comprises, in the compensation stage, turning on the third switch circuit through the scan signal, such that the third node discharges to the compensation signal through the driving circuit and the third switch circuit.

17. The pixel driving method according to claim 14, wherein:

the pixel driving method comprises, in the compensation stage, turning on the third switch circuit through the scan signal to transmit the second power signal to the fourth node.

* * * * *